US006419242B1

(12) United States Patent
Bauer

(10) Patent No.: US 6,419,242 B1
(45) Date of Patent: Jul. 16, 2002

(54) SNOWBOARD FRONT FOOT SNOW SHIELD

(76) Inventor: Peter P. Bauer, 15300 Sueview Dr., Las Gatos, CA (US) 95030

( * ) Notice: Subject to any disclaimer, the term of this patent is extended or adjusted under 35 U.S.C. 154(b) by 0 days.

(21) Appl. No.: 09/586,352

(22) Filed: Jun. 2, 2000

(51) Int. Cl.[7] ..... A63C 11/00; A41D 17/00
(52) U.S. Cl. ..... 280/14.22; 280/809; 36/2 R
(58) Field of Search ..... 280/809, 14.21, 280/811, 601, 600, 11.36, 14.22; 441/68, 70; 36/51, 2 R

(56) References Cited

U.S. PATENT DOCUMENTS

| | | | | | |
|---|---|---|---|---|---|
| 2,145,061 | A | * | 1/1939 | Stuart | 36/2 R |
| 2,229,563 | A | * | 1/1941 | Greenstein | 36/2 R |
| 2,382,150 | A | * | 8/1945 | Hartman | 441/70 |
| 2,420,618 | A | * | 5/1947 | Rabinovitz | 36/2 R |
| 2,740,972 | A | * | 4/1956 | Taylor | 441/70 |
| 2,900,648 | A | * | 8/1959 | Hedlund et al. | 441/70 |
| 3,360,812 | A | * | 1/1968 | Kluge | 441/70 |
| 3,395,410 | A | * | 8/1968 | Rutland et al. | 441/70 |
| 3,952,354 | A | | 4/1976 | Turner | |
| 4,255,369 | A | * | 3/1981 | Napier | 441/70 |
| 4,533,150 | A | | 8/1985 | Hardy | |
| 4,759,734 | A | * | 7/1988 | Scheurer et al. | 441/70 |
| 4,775,344 | A | * | 10/1988 | Anderson | 441/70 |
| 4,795,386 | A | * | 1/1989 | LaPoint | 441/70 |
| 4,822,310 | A | * | 4/1989 | Parker | 441/70 |
| 4,863,408 | A | * | 9/1989 | Lewis | 441/70 |
| 4,871,336 | A | * | 10/1989 | Scheurer | 441/70 |
| D314,221 | S | | 1/1991 | Miner | |
| 5,056,803 | A | * | 10/1991 | Teeter et al. | 441/70 |
| 5,163,550 | A | | 11/1992 | Hawk | |
| 5,213,535 | A | * | 5/1993 | Richens, Jr. | 441/70 |
| 5,649,722 | A | | 7/1997 | Champlin | |
| 5,692,321 | A | * | 12/1997 | Holstine | 441/70 |
| 5,815,948 | A | * | 10/1998 | Dzielak | 36/2 R |
| 6,174,212 | B1 | * | 1/2001 | Chang | 441/70 |

* cited by examiner

*Primary Examiner*—Brian L Johnson
*Assistant Examiner*—Jeffrey J. Restifo

(57) ABSTRACT

A snowboard front foot snow shield for helping cut through deep snow and keeping a snowboarder's front foot dry when snowboarding. The snowboard front foot snow shield includes a snowboard with a rear foot binding is coupled to a top face of the snowboard towards a back end of the snowboard and a front foot shield coupled to the top face of the snowboard between a front end of the snowboard and the rear foot binding. An inner face of the front foot shield defines a cavity for receiving a user's foot therein. The front foot shield has a back edge defining a back opening into the cavity.

1 Claim, 3 Drawing Sheets

10
11
14
30
17
18
23
12
13
24
10
15
14
17
11
30
31
19
18
22
16
32

24
21
13
23

SNOWBOARD FRONT FOOT SNOW SHIELD

BACKGROUND OF THE INVENTION

1. Field of the Invention

The present invention relates to snowboards and more particularly pertains to a new snowboard front foot snow shield for helping cut through deep snow and keeping a snowboarder's front foot dry when snowboarding.

2. Description of the Prior Art

The use of snowboards is known in the prior art. More specifically, snowboards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,163,550 by Hawk; U.S. Pat. No. 5,649,722 by Champlin; U.S. Pat. No. 4,533,150 by Hardy; U.S. Pat. No. 3,952,354 by Turner; U.S. Pat. No. 2,242,156 by Wallace; and U.S. Pat. No. Des. 314,221 by Miner.

While these devices fulfill their respective, particular objectives and requirements, the aforementioned patents do not disclose a new snowboard front foot snow shield. The inventive device includes a snowboard with a rear foot binding is coupled to a top face of the snowboard towards a back end of the snowboard and a front foot shield coupled to the top face of the snowboard between a front end of the snowboard and the rear foot binding. An inner face of the front foot shield defines a cavity for receiving a user's foot therein. The front foot shield has a back edge defining a back opening into the cavity.

In these respects, the snowboard front foot snow shield according to the present invention substantially departs from the conventional concepts and designs of the prior art, and in so doing provides an apparatus primarily developed for the purpose of helping cut through deep snow and keeping a snowboarder's front foot dry when snowboarding.

SUMMARY OF THE INVENTION

In view of the foregoing disadvantages inherent in the known types of snowboards now present in the prior art, the present invention provides a new snowboard front foot snow shield construction wherein the same can be utilized for helping cut through deep snow and keeping a snowboarder's front foot dry when snowboarding.

The general purpose of the present invention, which will be described subsequently in greater detail, is to provide a new snowboard front foot snow shield apparatus and method which has many of the advantages of the snowboards mentioned heretofore and many novel features that result in a new snowboard front foot snow shield which is not anticipated, rendered obvious, suggested, or even implied by any of the prior art snowboards, either alone or in any combination thereof.

To attain this, the present invention generally comprises a snowboard with a rear foot binding is coupled to a top face of the snowboard towards a back end of the snowboard and a front foot shield coupled to the top face of the snowboard between a front end of the snowboard and the rear foot binding. An inner face of the front foot shield defines a cavity for receiving a user's foot therein. The front foot shield has a back edge defining a back opening into the cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new snowboard front foot snow shield apparatus and method which has many of the advantages of the snowboards mentioned heretofore and many novel features that result in a new snowboard front foot snow shield which is not anticipated, rendered obvious, suggested, or even implied by any of the prior art snowboards, either alone or in any combination thereof.

It is another object of the present invention to provide a new snowboard front foot snow shield which may be easily and efficiently manufactured and marketed.

It is a further object of the present invention to provide a new snowboard front foot snow shield which is of a durable and reliable construction.

An even further object of the present invention is to provide a new snowboard front foot snow shield which is susceptible of a low cost of manufacture with regard to both materials and labor, and which accordingly is then susceptible of low prices of sale to the consuming public, thereby making such snowboard front foot snow shield economically available to the buying public.

Still yet another object of the present invention is to provide a new snowboard front foot snow shield which provides in the apparatuses and methods of the prior art some of the advantages thereof, while simultaneously overcoming some of the disadvantages normally associated therewith.

Still another object of the present invention is to provide a new snowboard front foot snow shield for helping cut through deep snow and keeping a snowboarder's front foot dry when snowboarding.

Yet another object of the present invention is to provide a new snowboard front foot snow shield which includes a snowboard with a rear foot binding is coupled to a top face of the snowboard towards a back end of the snowboard and a front foot shield coupled to the top face of the snowboard between a front end of the snowboard and the rear foot binding. An inner face of the front foot shield defines a cavity for receiving a user's foot therein. The front foot shield has a back edge defining a back opening into the cavity.

Still yet another object of the present invention is to provide a new snowboard front foot snow shield that lets a user slide more easily down a slope covered in deep powder-type snow by cutting a wedge in the snow in advance of the front leg of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new snowboard front foot snow shield embodying the principles and concepts of the present invention will be described.

As best illustrated in FIGS. 1 through 6, the snowboard front foot snow shield generally comprises a snowboard with a rear foot binding is coupled to a top face of the snowboard towards a back end of the snowboard and a front foot shield coupled to the top face of the snowboard between a front end of the snowboard and the rear foot binding. An inner face of the front foot shield defines a cavity for receiving a user's foot therein. The front foot shield has a back edge defining a back opening into the cavity.

Figures 1, 2:
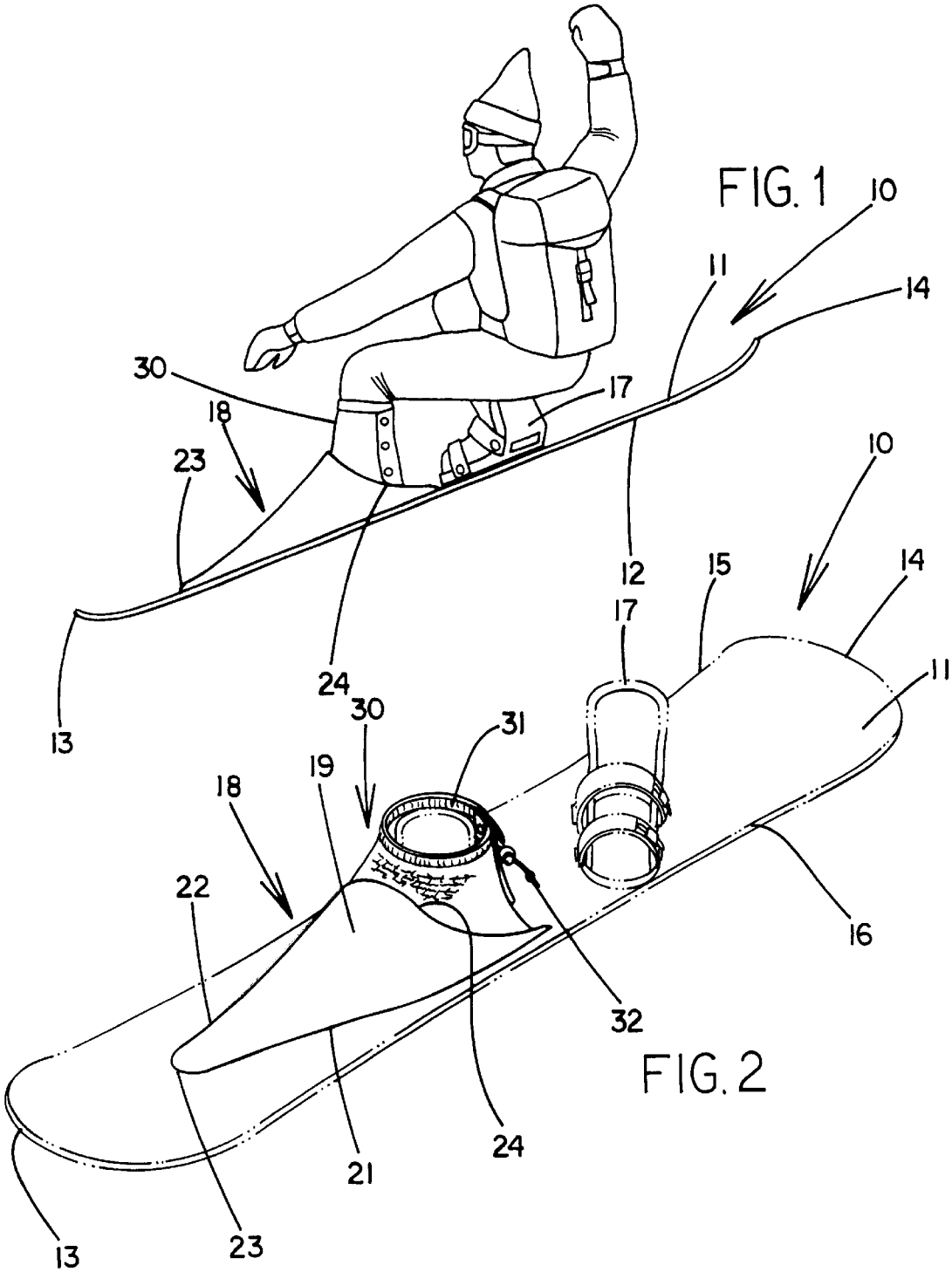
FIG. 1 is a schematic side view of a new snowboard front foot snow shield in use according to the present invention.
FIG. 2 is a schematic perspective view of the present invention.

In closer detail, the snowboard 10 has a top and bottom faces 11,12, opposite front and back ends 13,14, and a pair of sides 15,16 extending between the front and back ends of the snowboard. A rear foot binding 17 is coupled to the top face of the snowboard towards the back end of the snowboard. As illustrated in FIG. 1, in use, the rear foot binding is designed for receiving a rearwards positioned foot of a user standing on the snowboard to hold the rearwards positioned foot to the snowboard.

A generally semi-conical front foot shield 18 is coupled to the top face of the snowboard between the front end of the snowboard and the rear foot binding. The front foot shield has a longitudinal axis, arcuate outer and inner faces 19,20, a pair of lower edges 21,22, and tapers to a pointed front tip 23. The front tip is positioned towards the front end of the snowboard. The upper and inner faces each have a generally semi-circular transverse cross section taken substantially perpendicular to the longitudinal axis of the front foot shield.

Figure 3:
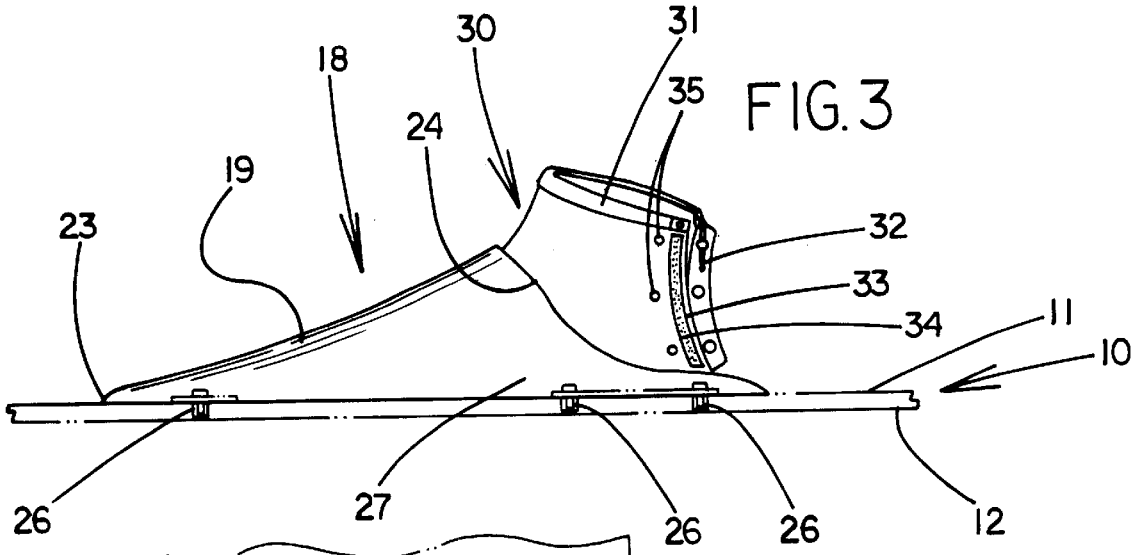
FIG. 3 is a schematic side view of the present invention.
Figure 4:
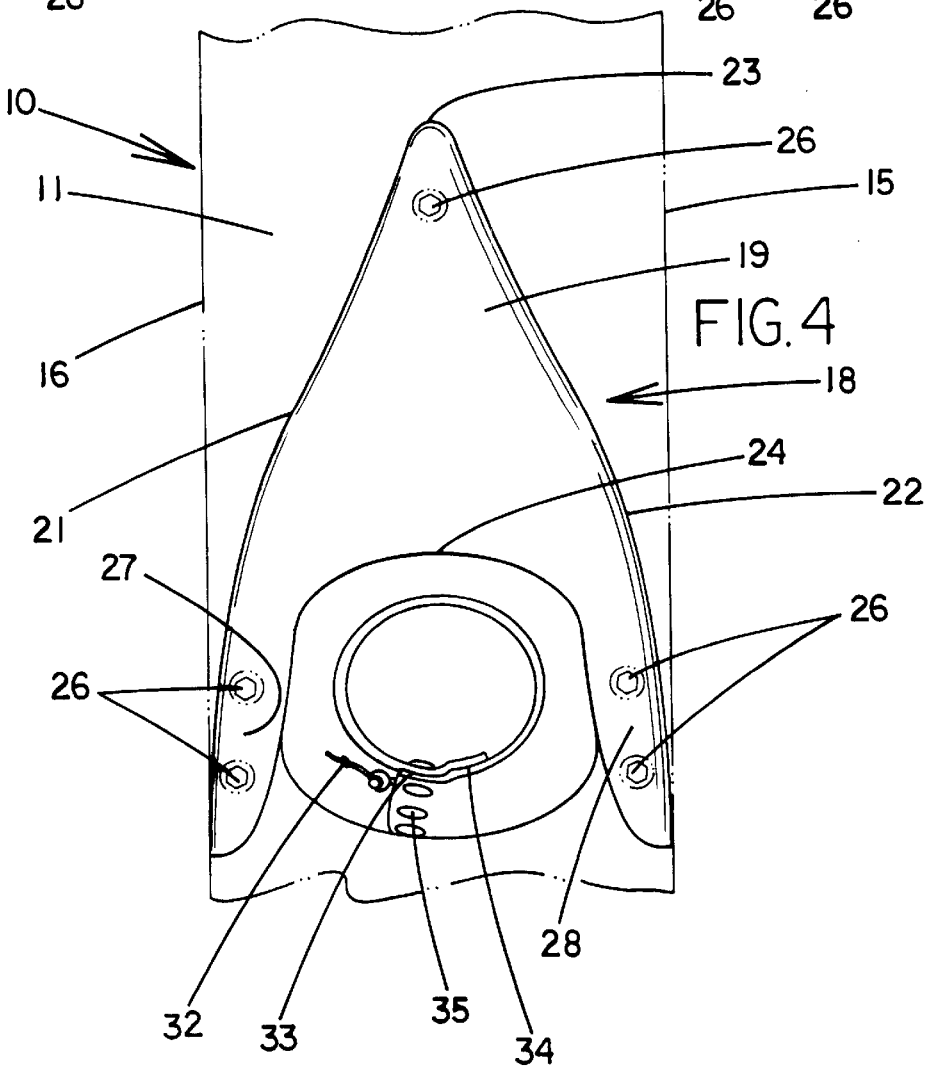
FIG. 4 is a schematic top view of the present invention.
Figure 5:
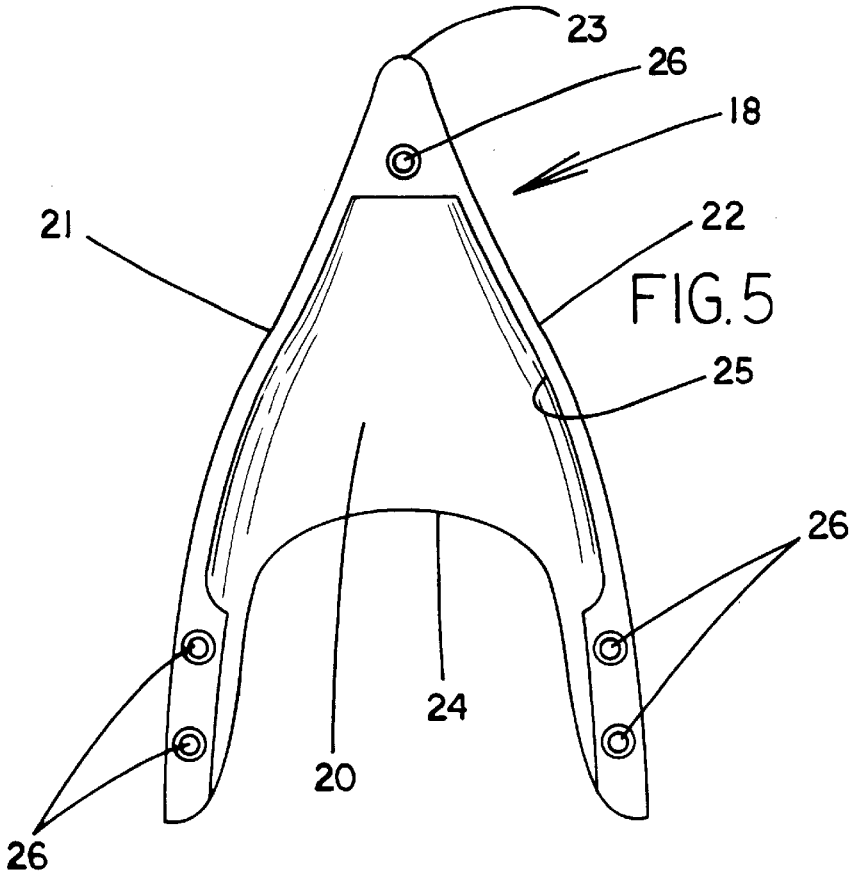
FIG. 5 is a schematic bottom view of the front foot shield of the present invention.

The inner face of the front foot shield defines a cavity. The front foot shield has a generally inverted U-shaped back edge 24 defining a back opening into the cavity. In use, the cavity of the front foot shield is designed for receiving therein a forwards foot of a user standing on the snowboard such that a forwards leg of the user upwardly extends through the back opening of the front foot shield. With reference to FIG. 3, the back edge of the front foot shield has an upper region spaced above the top face of the snowboard. The outer face of the front foot shield defines a front slope in a vertical plane in which the longitudinal axis of the front foot shield lies extending between the front tip and the upper region of the back edge of the front foot shield. The front slope is extended at an angle to the top face of the snowboard between about 20 degrees and about 60 degrees to provide an optimal angle for cutting through deep snow.

The lower edges of the front foot shield converging together at the front tip of the front foot shield. One of the lower edges of the front foot shield is positioned adjacent one of the sides of the snowboard at the back edge of the front foot shield and the other of the lower edges of the front foot shield is positioned adjacent the other of the sides of the snowboard at the back edge of the front foot shield.

The inner face of the of the front foot shield has a generally V-shaped inner flange 25 extending into the cavity along the lower edges of the front foot shield. The inner flange of the front foot shield is coupled to the top face of the snowboard to couple the front foot shield to the top face of the snowboard. Preferably, a plurality of snap fasteners 26 detachably couples the inner flange of the front foot shield to the top face of the snowboard. Ideally, at least one of the snap fasteners is positioned adjacent the front tip of the front foot shield. In this ideal embodiment, a first pair of the snap fasteners is positioned along a first of the lower edges of the front foot shield adjacent the back edge of the front foot shield and a second pair of the snap fasteners is positioned along a second of the lower edges of the front foot shield adjacent the back edge of the front foot shield.

Each of the snap fasteners preferably comprising a pair of complementary portions detachably attached to one another. One of the complementary portions of each snap fastener is provided on the inner flange of the front foot shield while the other of the complementary portions of each snap fastener is provided on the top face of the snowboard. Ideally, these portions of the snap fasteners are the same portions that come on most conventional snowboard for attaching convention front bindings to the snowboard.

Figure 6:
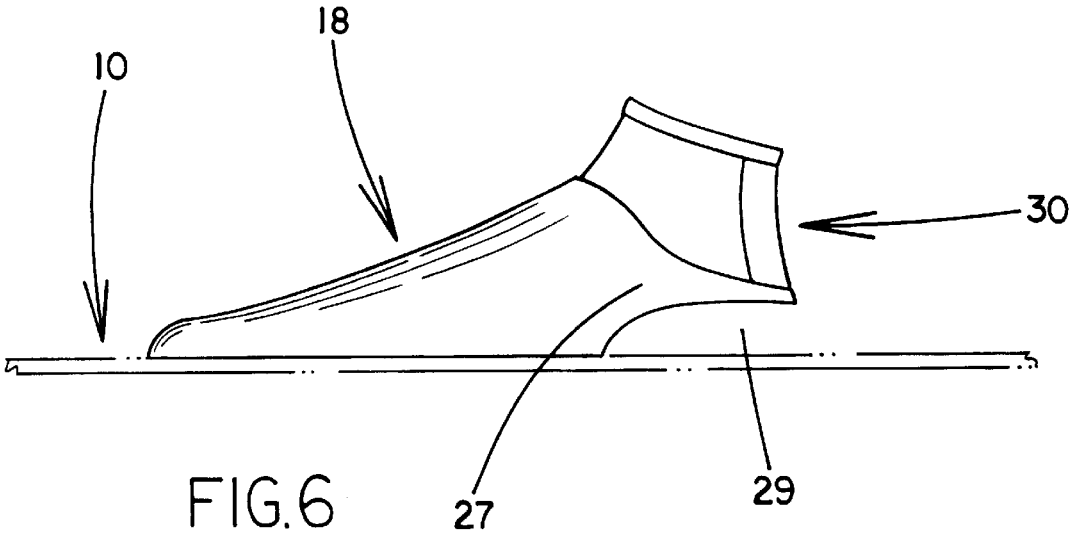
FIG. 6 is a schematic side view of a preferred embodiment of the present invention with a heel cutout.

Preferably, the front foot shield has a pair of generally triangular side portions 27,28 outwardly extending from the back edge of the front foot shield. A first of the side portions is positioned adjacent the first lower edge of the front foot shield and a second of the side portions is positioned adjacent the second lower edge of the front foot shield. As best illustrated in FIG. 3, the side portions of the front foot shield taper in a downwardly direction extending towards the back end of the snowboard. In this preferred embodiment, the first pair of snap fasteners is positioned adjacent the first side portion of the front foot shield and the second pair of snap fasteners is positioned adjacent the second side portion of the front foot shield. Optionally, as illustrated in FIG. 6, one of the side portions has an arcuate heel cutout 29 adjacent the adjacent the lower edge of the front foot shield. The heel cutout is designed for permitting the user to extend a portion of a heel of the forwardly positioned foot therein and therethrough.

In a preferred embodiment, a flexible tubular gaiter 30 upwardly extends from the back edge of the front foot shield. In use, the gaiter is designed for extending around the forwardly positioned leg of the user whose forwardly positioned foot is positioned in the cavity of the front foot shield as illustrated in FIG. 1. The gaiter has annular top and bottom edges, the bottom edge of the gaiter is coupled to the back edge of the front foot shield.

Preferably, the gaiter has a sleeve 31 extending therearound adjacent the top edge of the gaiter with a flexible elongate cinch cord 32 extending through the sleeve of the gaiter to permit constricting of the top edge of the gaiter around the forwardly positioned leg of the user to help prevent snow from entering the gaiter. Optionally, the gaiter may have an elastic band extending therearound adjacent the top edge of the gaiter with or without the presence of the sleeve. The elastic band is also designed for constricting the top edge of the gaiter around the forwardly positioned leg of the user to help prevent snow from entering the gaiter.

Preferably, the gaiter has a rearwards longitudinal slit 33 extending between the top and bottom edges of the gaiter and generally facing towards the back end of the snowboard. The gaiter has a fastener closing the longitudinal slit of the gaiter. Ideally, the fastener of the gaiter comprises a hook and loop fastener 34 with a plurality of snap fasteners 35. Optionally, the fastener of the gaiter may comprise a zipper fastener.

In use, the front shield helps cut through deep snow as the user is sliding down a slope on the snowboard to make it easier to slide down the slope.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snowboard system, comprising:

a snowboard having a top face, opposite front and back ends, and a pair of sides extending between said front and back ends of said snowboard;

a rear foot binding being coupled to said top face of said snowboard towards said back end of said snowboard, said rear foot binding being adapted for receiving a rearwards positioned foot of a user standing on said snowboard to hold the rearwards positioned foot to said snowboard;

a generally semi-conical front foot shield being coupled to said top face of said snowboard between said front end of said snowboard and said rear foot binding;

said front foot shield having arcuate outer and inner faces, a pair of lower edges, said pair of lower edges each having substantially straight forward portions that extend forwardly and converge together to form a generally pointed front tip said front end of said snowboard for directing snow coming over said front end of said snowboard toward said sides of said snowboard and away from a user's foot when the foot is positioned behind said front foot shield;

wherein said forward portions of said lower edges form an angle of approximately 50 degrees therebetween;

said upper and inner faces each having a generally semi-circular transverse cross section;

said inner face of said front foot shield defining a cavity, said front foot shield having a generally inverted U-shaped back edge defining a back opening into said cavity;

said cavity of said front foot shield being adapted for receiving therein a forwards foot of a user standing on said snowboard such that a forwards leg of the user upwardly extends through said back opening of said front foot shield;

one of said lower edges of said front foot shield being positioned adjacent one of said sides of said snowboard at said back edge of said front foot shield;

the other of said lower edges of said front foot shield being positioned adjacent the other of said sides of said snowboard at said back edge of said front foot shield;

said back edge of said front foot shield having an upper region spaced above said top face of said snowboard;

said outer face of said front foot shield defining a front slope extending between said front tip and said upper region of said back edge of said front foot shield;

said front slope being extended at an angle to said top face of said snowboard between about 20 degrees and about 60 degrees;

said lower edges of said front foot shield converging together at said front tip of said front foot shield;

said inner face of said of said front foot shield having a generally V-shaped inner flange extending into said cavity along said lower edges of said front foot shield;

said inner flange of said front foot shield being coupled to said top face of said snowboard to couple said front foot shield to said top face of said snowboard;

wherein a plurality of snap fasteners detachably couples said inner flange of said front foot shield to said top face of said snowboard;

at least one of said snap fasteners being positioned adjacent said front tip of said front foot shield;

a first pair of said snap fasteners being positioned along a first of said lower edges of said front foot shield adjacent said back edge of said front foot shield;

a second pair of said snap fasteners being positioned along a second of said lower edges of said front foot shield adjacent said back edge of said front foot shield;

each of said snap fasteners comprising a pair of complementary portions detachably attached to one another;

one of said complementary portions of each snap fastener being provided on said inner flange of said front foot shield;

the other of said complementary portions of each snap fastener being provided on said top face of said snowboard;

said front foot shield having a pair of generally triangular side portions outwardly extending from said back edge of said front foot shield;

a first of said side portions being positioned adjacent said first lower edge of said front foot shield, a second of said side portions being positioned adjacent said second lower edge of said front foot shield;

said side portions of said front foot shield tapering in a downwardly direction extending towards said back end of said snowboard;

said first pair of snap fasteners being positioned adjacent said first side portion of said front foot shield, said second pair of snap fasteners being positioned adjacent said second side portion of said front foot shield;

wherein one of said side portions has an arcuate heel cutout adjacent the adjacent said lower edge of said front foot shield, said heel cutout being adapted for permitting the user to extend a portion of a heel of the forwardly positioned foot therein;

a flexible tubular gaiter upwardly extending from said back edge of said front foot shield;

said gaiter being adapted for extending around the forwardly positioned leg of the user;

said gaiter having annular top and bottom edges, said bottom edge of said gaiter being coupled to said back edge of said front foot shield;

said gaiter having a sleeve extending therearound adjacent said top edge of said gaiter, a flexible elongate cinch cord being extended through said sleeve of said gaiter such that pulling on said cinch cord cinches said top edge of said gaiter from a relaxed condition to a constricted condition for reducing an effective perimeter size of said top edge of said gaiter and constricting of the top edge of said gaiter around the forwardly positioned leg of the user;

said gaiter having an elastic band extending therearound adjacent said top edge of said gaiter, said elastic band being adapted for constricting said top edge of said gaiter around the forwardly positioned leg of the user;

said gaiter having a rearwards longitudinal slit extending between said top and bottom edges of said gaiter, said longitudinal slit of said gaiter generally facing towards said back end of said snowboard; and said gaiter having a fastener closing said longitudinal slit of said gaiter.

* * * * *